US009103617B2

(12) United States Patent
McDonald

(10) Patent No.: US 9,103,617 B2
(45) Date of Patent: Aug. 11, 2015

(54) REAR FIREARM STABILIZER

(76) Inventor: Michael B. McDonald, Cordova, TN (US)

( * ) Notice: Subject to any disclaimer, the term of this patent is extended or adjusted under 35 U.S.C. 154(b) by 34 days.

(21) Appl. No.: 13/402,368

(22) Filed: Feb. 22, 2012

(65) Prior Publication Data

US 2013/0212921 A1 Aug. 22, 2013

(51) Int. Cl.
*F41A 23/06* (2006.01)

(52) U.S. Cl.
CPC ..... *F41A 23/06* (2013.01)

(58) Field of Classification Search
CPC ..... F41A 23/04; F41A 23/06; F41A 23/16; F41A 23/18; F41A 23/02; A01M 31/02
USPC ..... 42/94; 89/37.04
See application file for complete search history.

(56) References Cited

U.S. PATENT DOCUMENTS

| | | | | |
|---|---|---|---|---|
| 3,584,821 | A | 6/1971 | Glebe | |
| 4,575,964 | A * | 3/1986 | Griffin | 42/94 |
| 4,987,694 | A | 1/1991 | Lombardo | |
| 5,056,253 | A | 10/1991 | Willumsen | |
| 5,081,782 | A | 1/1992 | Wright | |
| 5,311,693 | A * | 5/1994 | Underwood | 42/94 |
| 5,345,706 | A * | 9/1994 | Brown | 42/94 |
| 5,402,595 | A | 4/1995 | Tamllos | |
| 5,410,835 | A * | 5/1995 | Vetter | 42/94 |
| 5,903,995 | A * | 5/1999 | Brubach | 42/94 |
| 5,937,560 | A | 8/1999 | Beltz | |
| 6,305,116 | B1 | 10/2001 | Parker | |
| 6,305,117 | B1 | 10/2001 | Hales, Sr. | |
| 6,546,662 | B1 | 4/2003 | Chong | |
| 6,574,899 | B1 | 6/2003 | Mostello | |
| 6,663,071 | B2 | 12/2003 | Peterson | |
| 6,772,549 | B2 | 8/2004 | Muhlestein | |
| 6,889,465 | B1 * | 5/2005 | Holmes | 42/94 |
| 7,124,528 | B2 | 10/2006 | Long | |
| 7,375,269 | B2 * | 5/2008 | Perkins | 84/327 |
| 7,565,762 | B2 | 7/2009 | Lackey | |
| 7,654,498 | B1 | 2/2010 | Beltz | |
| 7,784,212 | B1 | 8/2010 | Chilton | |
| 2002/0040544 | A1 | 4/2002 | Muhlestein | |
| 2003/0042388 | A1 * | 3/2003 | Peterson | 248/440.1 |
| 2003/0205653 | A1 | 11/2003 | Peterson | |
| 2005/0262753 | A1 | 12/2005 | Lahti | |
| 2007/0261287 | A1 * | 11/2007 | Hunt et al. | 42/94 |

(Continued)

FOREIGN PATENT DOCUMENTS

GB 15 208 * 4/1916

OTHER PUBLICATIONS

International Search Report and Written Opinion issued Mar. 29, 2013 in corresponding International Application No. PCT/US2013/023018 filed Jan. 24, 2013.

(Continued)

*Primary Examiner* — Stephen M Johnson
(74) *Attorney, Agent, or Firm* — Angela Holt; Bradley Arant Boult Cummings LLP

(57) ABSTRACT

A device for stabilizing a firearm comprises a support extending upwardly from a surface. A flexible strap flexibly affixed to an upper end of the support is grasped by a user and sandwiched between the grip of the firearm and the palm of his firing hand. The user applies a force on the strap in a direction toward the surface to brace the support against the surface and add stability to the rear of the firearm.

9 Claims, 4 Drawing Sheets

(56) References Cited

U.S. PATENT DOCUMENTS

| | | | | |
|---|---|---|---|---|
| 2011/0173867 | A1 | 7/2011 | Young | |
| 2011/0247256 | A1 | 10/2011 | Lickteig | |
| 2012/0272561 | A1* | 11/2012 | Risley | 42/96 |

OTHER PUBLICATIONS

Cabela's World's Foremost Outfitter Shooting Summer 2011 Catalogue, pp. 54-59.

* cited by examiner

REAR FIREARM STABILIZER

BACKGROUND AND SUMMARY OF THE INVENTION

A stabilizer for stabilizing the rear of a firearm while firing is provided. The stabilizer comprises a support extending upwardly from a surface. A flexible strap flexibly affixed to an upper end of the support is grasped by a user and sandwiched between the grip of the firearm and the palm of his firing hand. The user applies a force on the strap in a direction toward the surface to brace the support against the surface and add stability to the rear of the firearm.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
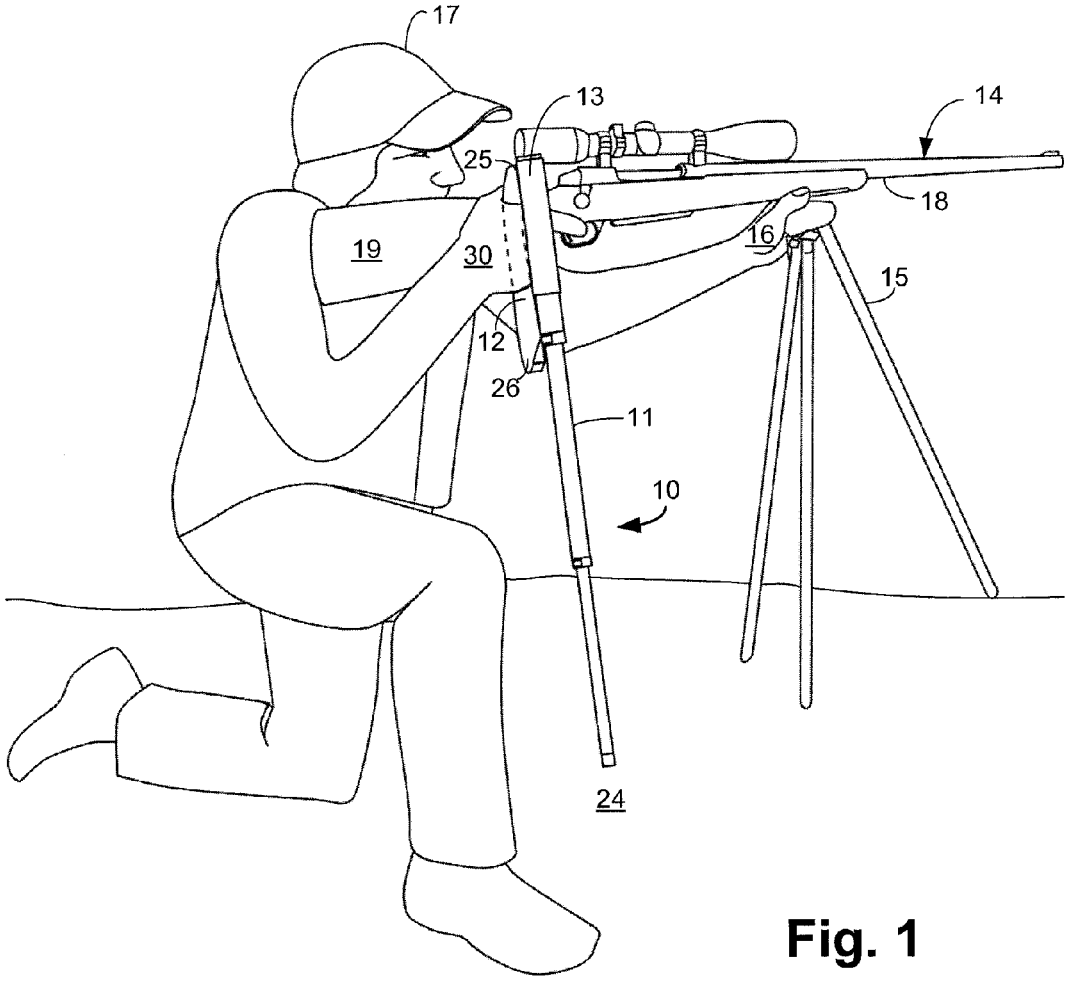
FIG. 1 is a right side view of a stabilizer in use to stabilize a firearm.

FIG. 1 is a side view of a rear firearm stabilizer 10 according to an embodiment of the present disclosure. The stabilizer 10 provides support for a firearm 14, such as a rifle, during operation of the firearm 14. Prior art devices for supporting firearms generally support the firearm 14 at only one point, for example, via a tripod device 15 disposed near a front end 18 of the firearm 14. The stabilizer 10 of the present disclosure provides a second point of stabilization near a grip 23 (FIG. 4) of the firearm 14. This additional stabilization greatly decreases the effect of a user's body movement on the rifle.

The stabilizer 10 comprises a support 11 that extends generally upwardly from a surface 24, such as the earth, against which the support 11 is braced. A strap 12 is affixed at its upper end 25 to an upper end 13 of the support 11 and extends downwardly therefrom. A lower end 26 of the strap 12 is attached to the support 11. The strap 12 is comprised of padded flexible canvas fabric in the illustrated embodiment, but may be formed from other suitable flexible materials in other embodiments.

In operation of the stabilizer 10, a user 17, who may be in a kneeling position as shown, or in a standing, prone, or other position, holds the firearm 14 in a firing position. A traditional tripod 15 or bipod and the user's left hand 16 (for a right-handed user) stabilizes a front end 18 of the firearm 14 in the illustrated embodiment. The stabilizer 10 stabilizes a rear end 19 of the firearm 14. In this regard, the user's trigger hand 30 grasps the strap 12 near its upper end 25 with the strap 12 in the palm of the hand 30. In grasping the firearm 14, the user 17 may grip the firearm 14 a little higher than in the firing position, sandwiching the strap 12 between the palm of the hand 30 and the grip of the firearm 14, drawing the strap 12 taut and thus putting a force against the stabilizer 10 in a direction towards the surface 24, e.g., a downward direction if the support 11 of the stabilizer is generally vertically-oriented. The user's hand 30 is thus disposed in a space between the support 11 and the strap 12. The back side of the user's hand 30 is generally adjacent to, and lightly contacting, the support 11. In this manner, the strap 12 and stabilizer 10 add stability to the rear end 19 of the firearm 14.

Figure 2:
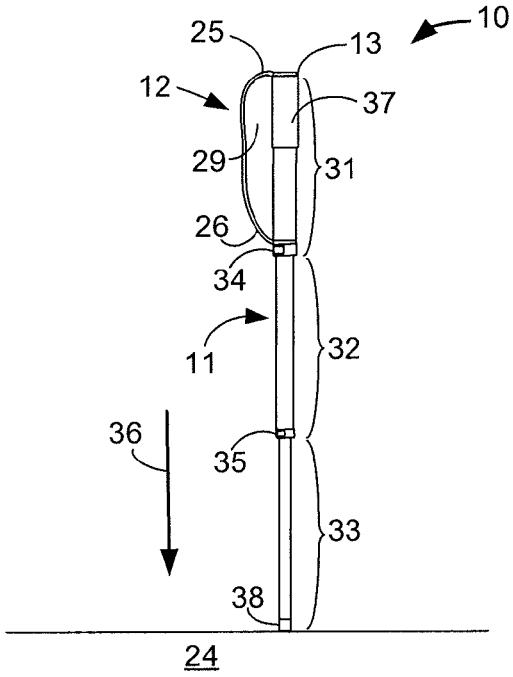
FIG. 2 is a side plan view of a stabilizer according to an embodiment of the present disclosure.

FIG. 2 is a side view of a stabilizer 10 according to an embodiment of the present disclosure. The support 11 comprises a plurality of telescoping sections 31, 32, and 33 that are adjustably affixed together. In this regard, a top section 31 is adjustably affixed to a center section 32 via a clamp 34. The clamp 34 releases to allow the center section 32 to slide within the top section 31, and tightens to cause the center section 32 to be rigidly affixed to the top section 31. Similarly, the center section 32 is adjustably affixed to a bottom section 33 via a clamp 35. The clamp 35 releases to allow the bottom section 33 to slide within the center section 32, and tightens to cause the bottom section 33 to be rigidly affixed to the center section 32. By adjusting the positions of the sections 31, 32 and 33 relative to one another via the clamps 34 and 35, the overall length of the support 11 may be adjusted. This adjustability allows the same stabilizer 10 to be used by the user 17 (FIG. 1) in a variety of positions, e.g., prone, kneeling, standing, and seated (such as in a deer stand or on a high rack).

The clamps 34 and 35 are frictional clamps in the illustrated embodiment. However, any type of mechanism that will retain the sections 31, 32 and 33 in the desired position with respect to each other may be used for the clamps 34 and 35.

The illustrated embodiment shows three sections 31, 32, and 33 telescoping together to form the support 11. In other embodiments, more or fewer sections may be employed. Still other embodiments of the support 11 do not telescope at all, and in this regard may be formed from a solid length of material. In one embodiment, the support 11 extends to about 66 inches, though shorter and longer lengths are provided in other embodiments.

The upper end 25 of the strap 12 is affixed to the support 11 near the upper end 13 of the support 11. The lower end 26 of the strap 12 is affixed to the support 11 on the top section 31 above the clamp 34. The strap 12 is not taut against the support 11, and thus there is a space 29 between the support 11 and the strap 12.

An upper portion 37 of the top section 31 may be padded, such as, with foam-like padding. In operation of the stabilizer 10, the user 17 (FIG. 1) inserts his trigger hand 30 (FIG. 1) within the space 29, with the strap 12 in his palm (not shown) and the back of his hand adjacent to, and lightly contacting, the upper portion 37 of the top section 31. The user 17 grasps the strap 12 and the firearm 14 (FIG. 1) as described above and exerts force on the strap 12, and thus on the support 11, in a direction toward the surface 24. This direction is indicated by directional arrow 36 in FIG. 2. The direction 36 is generally vertically downward in FIG. 2, because the support 11 is oriented generally vertically. In other embodiments, the direction of force is differently-oriented, depending upon the orientation of the support 11 when it is in use.

A bottom tip 38 of the support 11 contacts the surface 24. In the illustrated embodiment, the bottom tip 38 is formed from non-skid material, such as rubber or plastic. In other embodiments, the bottom tip 38 may be spiked or pointed to extend into the earth to add further stability.

Figure 3:
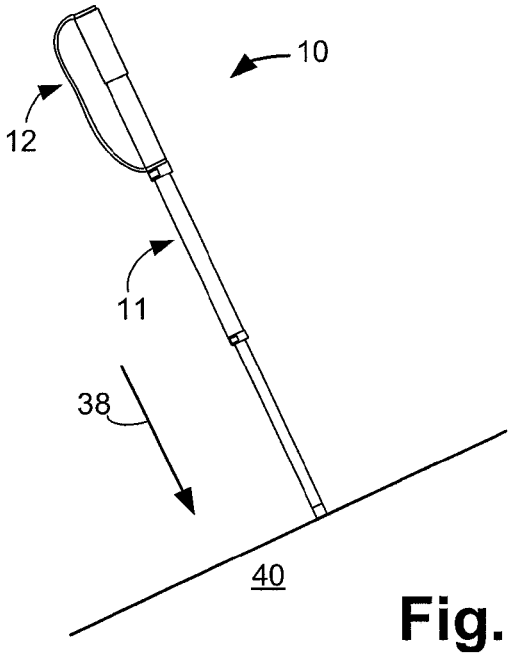
FIG. 3 is a side view of the stabilizer of FIG. 2, shown in connection with an angled surface.

FIG. 3 is a side view of the stabilizer 10 of FIG. 2, shown in use on an angled surface 40. In this regard, the stabilizer 10 may be used in uneven terrain where there are no available horizontal surfaces to brace the support 11 against. In such an instance, the user 17 (FIG. 1) exerts a force against the strap 12 in a direction towards the surface 40, i.e., in a direction as indicated by directional arrow 38, which is at an angle other than a true vertical. In other words, the force exerted by the user 17 on the strap 12 should be in the direction towards the surface at an angle generally similar to that of the support with respect to the surface.

Figure 4:
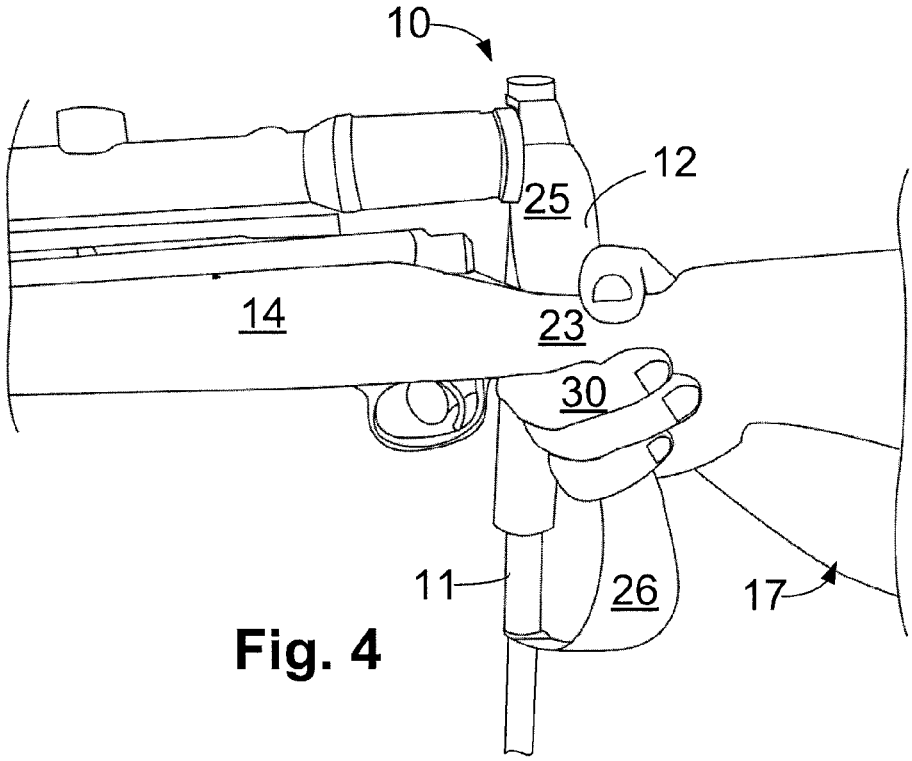
FIG. 4 is an enlarged partial left side view of the stabilizer of FIG. 1.

FIG. 4 is an enlarged opposite side view of the stabilizer 10 of FIG. 1. The lower end 26 of the strap 12 extends downwardly from the user's hand 30, while the upper end 25 of the strap 12 is pulled taut by the user's hand 30. The downward force on the strap 12 braces the support 11 against the ground (not shown) and causes the support 11 to remain in a generally vertical orientation in this embodiment. Because the strap 12 is fabricated from flexible canvas in this embodiment, the user maintains a comfortable grip on the firearm 14, even with the strap 12 sandwiched between the grip 23 of the firearm 14 and the palm of the user's hand 30.

Figure 5:
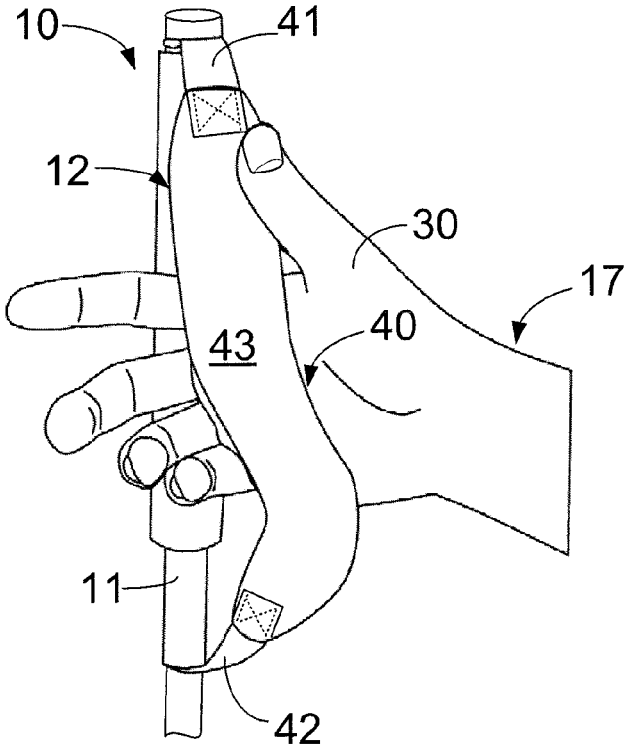
FIG. 5 is an enlarged partial left side view of the stabilizer of FIG. 1.

FIG. 5 is an enlarged partial left side view of the stabilizer 10 of FIG. 1, showing a strap 12 according to an embodiment of the present disclosure. In this embodiment, the strap 12 comprises a padded central portion 43 connected to the support 11 via a top strap portion 41 and a bottom strap portion 42. The top strap portion 41 and bottom strap portion 42 comprise canvas strap material that is known in the art. The padded central portion 43 comprises padded canvas fabric stitched via thread to the top strap portion 41 and bottom strap portion 42.

Figure 6:
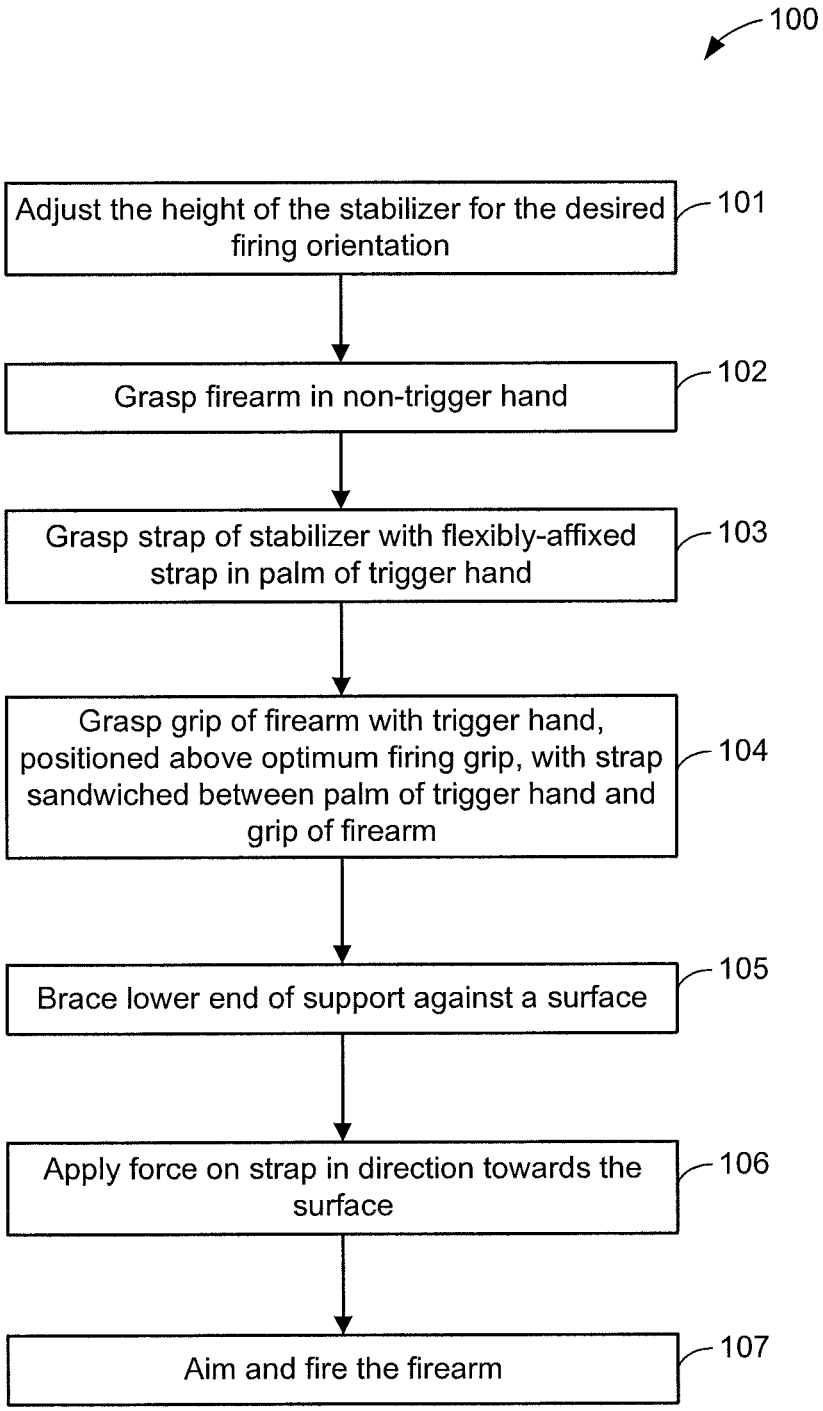
FIG. 6 is a method of stabilizing a firearm according to an embodiment of the present disclosure.

FIG. 6 illustrates a method of stabilizing a firearm 14 (FIG. 1) according to an embodiment of the present disclosure. In step 101, the user 17 (FIG. 1) adjusts the height of the support 11 (FIG. 1) for the desired firing orientation by operating the clamps 34 and 35 (FIG. 2) to slide the sections 31, 32, 33 (FIG. 2) with respect to one another until the support 11 is at the desired height. For example, if the user 17 plans to operate the firearm 14 in a prone position (i.e., lying on the ground), the user 17 adjusts the height of the support 11 to a shorter length. If the user 17 plans to operate the firearm from a standing position, the user adjusts the height of the support to a longer length.

In step 102, the user 17 grasps the firearm 14 (FIG. 1) in his or her non-trigger hand. If the user is using a tripod 15 (FIG. 1) to stabilize the front end 18 (FIG. 1) of the firearm, the user positions the front end of the firearm on the tripod.

In step 103 of the method, the user grasps with his or her trigger hand the strap 12 (FIG. 1) of the stabilizer 10 (FIG. 1) that has a support 11 with a flexibly-affixed strap 12. In step 104, the user 17 grasps the grip 23 (FIG. 4) of the firearm 14 with his or her trigger hand, positioned slightly higher on the strap than optimum position for firing the firearm 14. This initial higher position is desired because the user 17 will be applying downward force on the strap 12 and sliding the strap slightly downward before firing. The strap 12 is sandwiched between the grip 23 and the palm of the user's trigger hand.

In step 105, the user braces the bottom tip 38 of the support 11 against the surface 24 (FIG. 2). This step may be performed prior to step 104, in some embodiments. In step 106, the user 17 applies force against the strap in a direction towards the surface 24. In step 107, the user aims and fires the firearm 14.

The invention claimed is:

1. A system for stabilizing a rear portion of a firearm, comprising:

a firearm;

a support extending upwardly from a surface, the support comprising an upper end and a lower end, the lower end comprising a bottom tip contactable with the surface;

a flexible strap secured to the upper end of the support, the flexible strap extending downwardly from the upper end of the support, creating a space between the support and the flexible strap, the flexible strap grippable by a user's hand positioned within the space, the flexible strap adapted relative to the support such that when the strap and a grip of the firearm are gripped by a user's hand, an outside surface of the strap couples to the grip such that a force exerted on the strap is translated to the support, causing the support to stabilize a rear portion of the firearm, the strap comprising an upper end flexibly affixed to the upper end of the support and a lower end flexibly affixed to the support below the upper end of the support;

the support adapted and arranged relative to the strap such that the support is contactable with a back of the user's hand when the system is in use.

2. The system of claim 1, wherein the support is telescopically adjustable in length.

3. The system of claim 1, wherein the flexible strap comprises padded canvas fabric.

4. The system of claim 1, wherein the bottom tip is spiked to extend into the surface.

5. The system of claim 1, wherein the bottom tip is formed from non-skid material.

6. A system for stabilizing a firearm, comprising:

a firearm;

a unipod support braceable against a surface, the support comprising a captive end and a brace end, the brace end comprising a bottom tip contactable with the surface;

a flexible strap secured to the captive end of the support, the flexible strap extending from the upper end of the support, the flexible strap adapted relative to the captive end of the support such that when the strap and a grip of the firearm are gripped by a user's hand, an outside surface of the strap couples to the grip such that a force exerted on the strap is translated to the support, causing the support to stabilize a rear portion of the firearm, the strap comprising an upper end flexibly affixed to the captive end of the support and a lower end flexibly affixed to the support below the captive end of the support.

7. The system of claim 6, wherein the flexible strap comprises padded canvas fabric.

8. The system of claim 6, wherein the bottom tip is spiked to extend into the surface.

9. The system of claim 6, wherein the bottom tip is formed from non-skid material.

* * * * *